US012454780B1

(12) United States Patent
Lu

(10) Patent No.: US 12,454,780 B1
(45) Date of Patent: Oct. 28, 2025

(54) GARMENT BACK SLIT STITCHING TEMPLATE

(71) Applicant: BOSIDENG DOWN WEAR LIMITED, Jiangsu (CN)

(72) Inventor: Jingfang Lu, Jiangsu (CN)

(73) Assignee: BOSIDENG DOWN WEAR LIMITED, Jiangsu (CN)

( * ) Notice: Subject to any disclaimer, the term of this patent is extended or adjusted under 35 U.S.C. 154(b) by 0 days.

(21) Appl. No.: 19/256,040

(22) Filed: Jun. 30, 2025

Related U.S. Application Data

(63) Continuation of application No. PCT/CN2025/072176, filed on Jan. 14, 2025.

(30) Foreign Application Priority Data

Feb. 7, 2024 (CN) ..... 202410172019.8

(51) Int. Cl.
*D05B 35/02* (2006.01)

(52) U.S. Cl.
CPC ..... *D05B 35/02* (2013.01)

(58) Field of Classification Search
CPC ..... D05B 35/02; D05B 97/00; D05B 97/02; D05B 97/12; D05D 2305/02
See application file for complete search history.

(56) References Cited

U.S. PATENT DOCUMENTS

| | | | | |
|---|---|---|---|---|
| 7,281,337 | B1 * | 10/2007 | Oehlke | D05B 97/12 33/566 |
| 2012/0145058 | A1 * | 6/2012 | Oe | D05B 97/02 112/475.01 |

FOREIGN PATENT DOCUMENTS

| | | | |
|---|---|---|---|
| CN | 107326547 | | 11/2017 |
| CN | 210796873 | | 6/2020 |
| CN | 215668460 | | 1/2022 |
| CN | 216712423 | | 6/2022 |
| JP | H10277284 A | * | 10/1998 |
| WO | 2019237699 | | 12/2019 |

OTHER PUBLICATIONS

"International Search Report (Form PCT/ISA/210) of PCT/CN2025/072176," mailed on Feb. 24, 2025, pp. 1-3.
"Written Opinion of the International Searching Authority (Form PCT/ISA/237) of PCT/CN2025/072176," mailed on Feb. 24, 2025, pp. 1-4.

* cited by examiner

*Primary Examiner* — Nathan E Durham
(74) *Attorney, Agent, or Firm* — JCIPRNET

(57) ABSTRACT

Disclosed is a garment back slit stitching template, including a base plate and a panel that are foldably connected to each other, and foldable first and second cover plates are arranged between the base plate and the panel; a first stitching channel extends through the base plate and the panel for stitching and joining garment back slit pieces together, a second stitching channel extends through the base plate, the first cover plate, and the panel, a third stitching channel extends through the base plate, the first cover plate, the second cover plate, and the panel, and the second and third stitching channels are configured to stitch corners of the garment back slit pieces; the first cover plate is provided with a first edge and a second edge, the garment back slit pieces are folded along the first edge, and the garment back slit pieces are folded along the second edge.

8 Claims, 7 Drawing Sheets

GARMENT BACK SLIT STITCHING TEMPLATE

CROSS-REFERENCE TO RELATED APPLICATION

This application is a continuation of international application of PCT application serial no. PCT/CN2025/072176, filed on Jan. 14, 2025, which claims the priority benefit of China application no. 202410172019.8, filed on Feb. 7, 2024. The entirety of each of the above-mentioned patent applications is hereby incorporated by reference herein and made a part of this specification.

TECHNICAL FIELD

The present disclosure belongs to the technical field of stitching and fabric alignment devices, and relates to a garment stitching template.

RELATED ART

A trench coat often has a back vent at a lower back hem. During production, two side vents are required to be equal in length, and angles thereof are straight. However, the current stitching process for the vents involves manually folding a hem section and then fixing into shape by stitching. This operation requires highly skilled workers and results in low processing efficiency. In addition, the finished products are prone to uneven side lengths, leading to an unsightly appearance and poor quality.

SUMMARY OF INVENTION

In view of the deficiencies in the prior art, an objective of the present disclosure is to provide a garment back slit stitching template, with the purpose of reducing reduce the time spent on marking and positioning, improving processing efficiency, reducing dependence on worker skill, and ensuring the stitching quality.

Technical solution of the present disclosure is as follows: a garment back slit stitching template, including a base plate and a panel that are foldably connected to each other, and a foldable first cover plate and a foldable second cover plate are arranged between the base plate and the panel; the garment back slit stitching template is provided with a first stitching channel, a second stitching channel, and a third stitching channel, where the first stitching channel extends through both the base plate and the panel, and the first stitching channel is configured to stitch and join garment back slit pieces together; the second stitching channel extends through the base plate, the first cover plate, and the panel, the third stitching channel extends through the base plate, the first cover plate, the second cover plate, and the panel, and the second stitching channel and the third stitching channel are configured to stitch corners of the garment back slit pieces; the first cover plate is provided with a first edge and a second edge, the garment back slit pieces are folded along the first edge to cover the third stitching channel on the first cover plate, and the garment back slit pieces are folded along the second edge to cover the second stitching channel on the first cover plate; and the second cover plate is provided with a third edge, and the garment back slit pieces are folded along the third edge to cover the third stitching channel on the second cover plate.

Further, a limiting convex strip is provided on the base plate, and at least a portion of the limiting convex strip extends along a side edge of the first stitching channel.

Further, the limiting convex strip is a sponge strip.

Further, the second cover plate is foldably connected to the first cover plate.

Further, first grip strips are arranged on opposite surfaces of the base plate and the panel, and are located on a side edge of the first stitching channel and a side edge of the second stitching channel; second grip strips are arranged on a surface of the first cover plate facing the panel, and are located on the side edge of the second stitching channel and a side edge of the third stitching channel; and a third grip strip is arranged on a surface of the second cover plate facing the panel, and is located on the side edge of the third stitching channel.

Further, the garment back slit stitching template further includes a third cover plate, where the third cover plate is foldably covered on the first cover plate, and the second stitching channel extends through the third cover plate.

Further, a fourth grip strip is arranged on a surface of the third cover plate facing the first cover plate, and is located on a side edge of the second stitching channel.

Further, the garment back slit stitching template further includes a fourth cover plate, where the fourth cover plate is foldably covered on the second cover plate, and the third stitching channel extends through the fourth cover plate.

Further, a fourth grip strip is arranged on a surface of the fourth cover plate facing the second cover plate, and is located on a side edge of the third stitching channel Further, the first stitching channel on the base plate is covered with a horsehair lining.

Compared with the prior art, the present disclosure has the advantages:

In the present disclosure, the left and right back slit pieces are stitched and joined together by using the first stitching channel on the garment back slit stitching template, one of the back slit pieces is folded by using the first cover plate, and edges and corners of the two back slit pieces are sewn by using the first cover plate and the second cover plate are sewn, and then further sewn through the second stitching channel and the third stitching channel, such that stitching of the back slit can be completed through only two stitching operations, which results in a high level of symmetry of the back slit, not only saving time in positioning and stitching, improving efficiency, but also significantly reducing the difficulty of stitching, ensuring consistent and stable product specifications and quality, and improving the aesthetics of garment.

DESCRIPTION OF EMBODIMENTS

Figure 1:
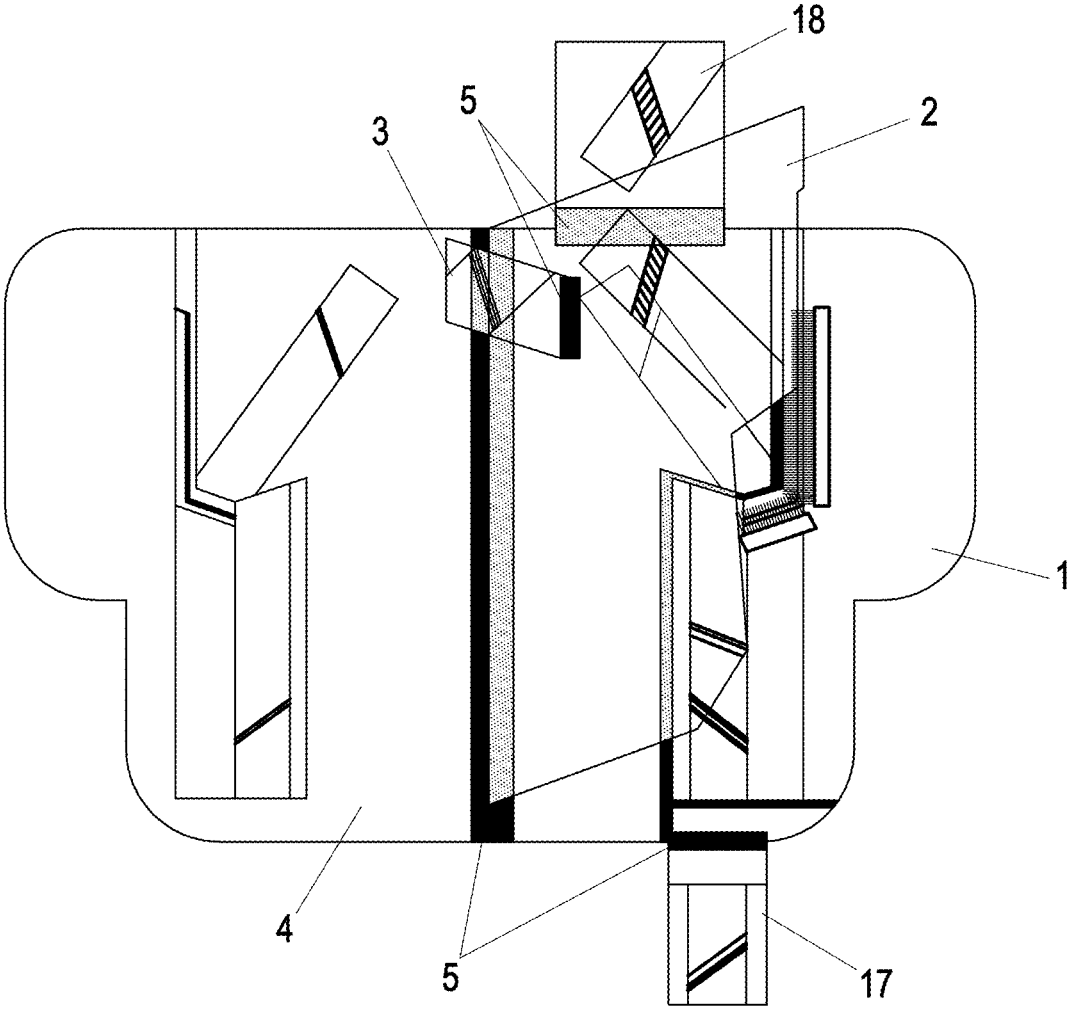
FIG. 1 is a schematic structural diagram of a garment back slit stitching template according to an embodiment of the present disclosure.
Figure 2:
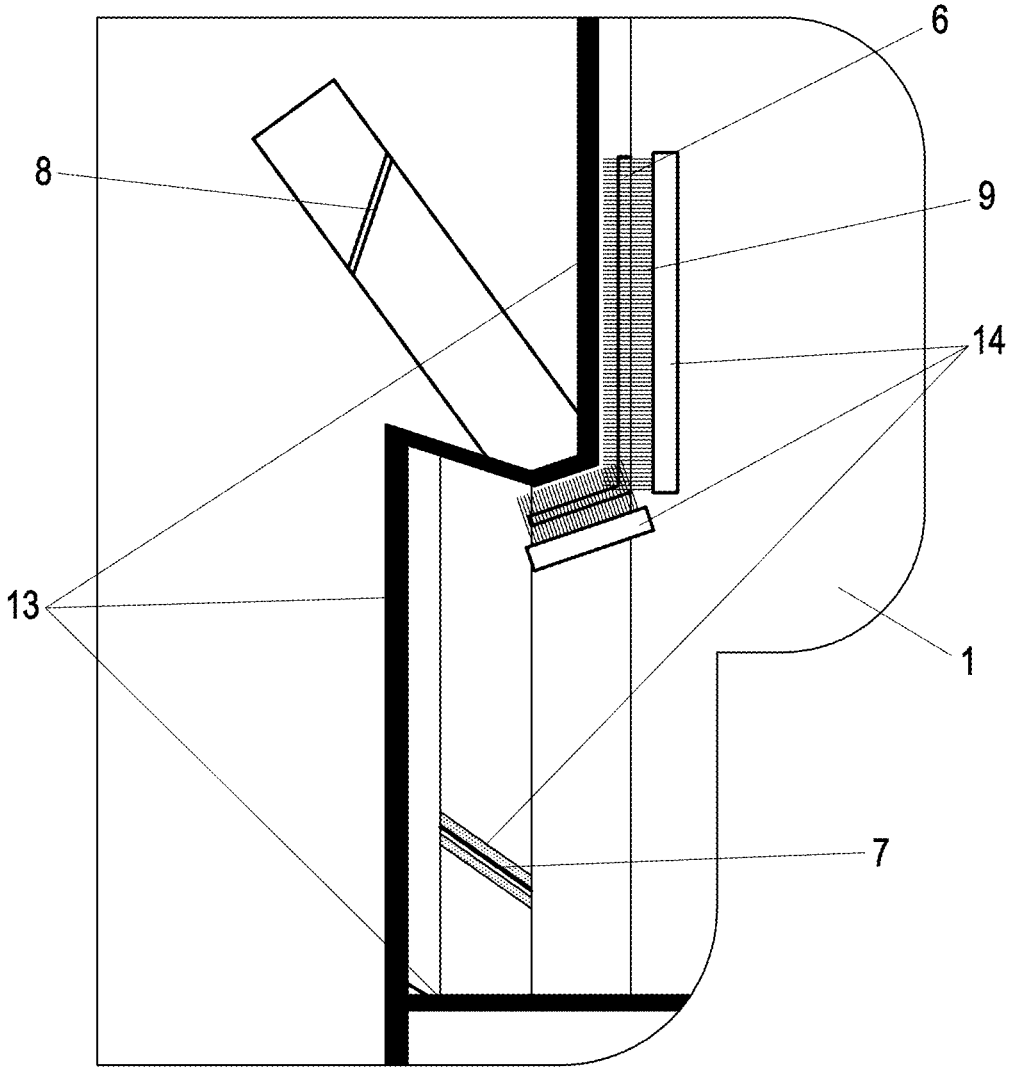
FIG. 2 is a schematic structural diagram of a base plate of a garment back slit stitching template according to an embodiment of the present disclosure.
Figure 3:
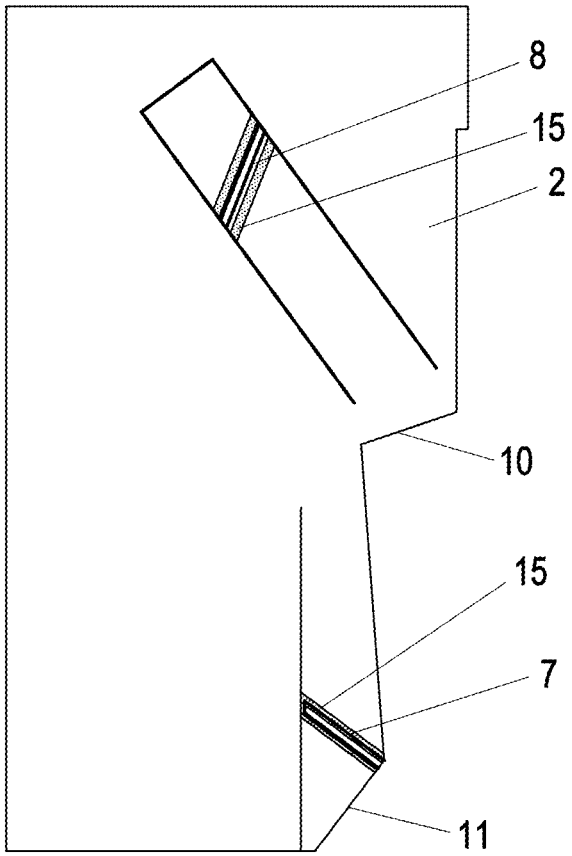
FIG. 3 is a schematic structural diagram of a first cover plate of a garment back slit stitching template according to an embodiment of the present disclosure.
Figure 4:
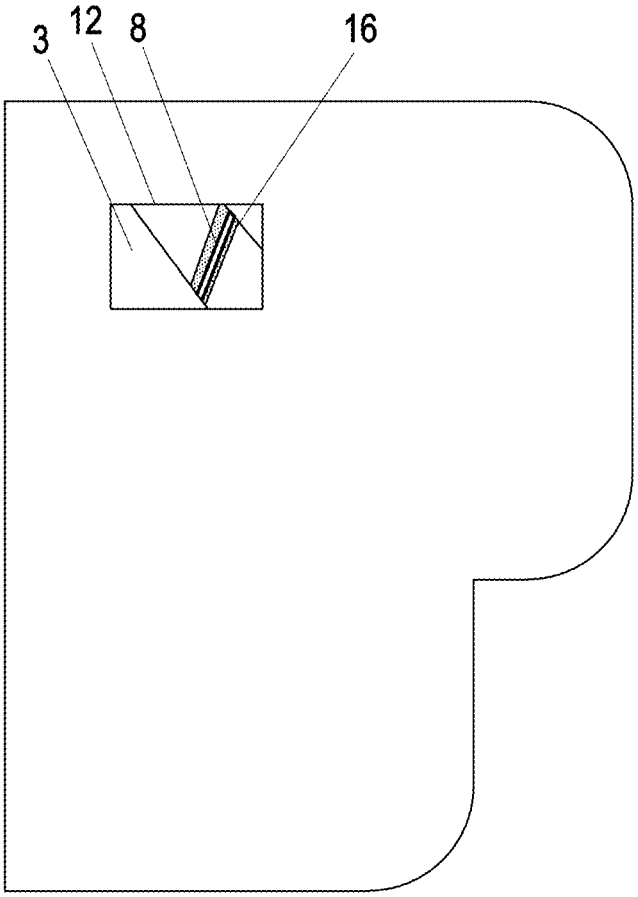
FIG. 4 is a schematic structural diagram of a second cover plate of a garment back slit stitching template according to an embodiment of the present disclosure.

The present disclosure will be further elaborated hereafter in conjunction with the embodiments, which, however, are not taken as limitations on the present disclosure.

Referring to FIGS. 1-4 and FIGS. 7-8, a garment back slit stitching template of this embodiment includes a base plate 1, a first cover plate 2, a second cover plate 3, and a panel 4, where the base plate 1, the first cover plate 2, and the panel 4 are folded and connected on one side, and the first cover plate 2 is located between the base plate 1 and the panel 4. Specifically, a flexible connecting strip 5, such as a kraft paper adhesive strip, can be used for connection, such that the base plate 1, the first cover plate 2, and the panel 4 may be overlapped or opened with each other. It should be noted that a connection position between the first cover plate 2 and the base plate 1 can be different form a connection position between the base plate 1 and the panel 4, as long as the purpose of allowing each part to fold individually.

The second cover plate 3 is foldably connected between the first cover plate 2 and the panel 4 using the flexible connecting strip 5. In this embodiment, the second cover plate 3 is foldably connected to the side of the first cover plate 2 facing the panel 4, with the advantage that no matter where the first cover plate 2 is located, when the second cover plate 3 is overlapped with the first cover plate 2, relative positions of the first cover plate and the second cover plate are more precise, which is conducive to improving the quality of the back slit corners.

The garment back slit stitching template is provided with three stitching channels: a first stitching channel 6, a second stitching channel 7, and a third stitching channel 8, where the first stitching channel 6 is configured to join and stitch two garment back slit pieces, the second stitching channel 7 and the third stitching channel 8 are configured to stitch corners of the two garment back slit pieces, respectively.

The first stitching channel 6 extends through both the base plate 1 and the panel 4, that is, the base plate 1 is provided with one first stitching channel 6, the panel 4 is also provided with one first stitching channel 6, and the two first stitching channels overlap when the base plate 1 and the panel 4 are covered together. An area of the first cover plate 2 is smaller than areas of the base plate 1 and the panel 4, therefore, the first cover plate 2 cannot cover a position of the first stitching channel 6. Further, in a preferred embodiment, the first stitching channel 6 on the base plate 1 is covered with a horsehair lining 9, so as to ensure looseness level of a quilting thread and prevent the quilting thread from tightening together.

The second stitching channel 7 extends through the base plate 1, the first cover plate 2 and the panel 4, that is, the base plate 1 is provided with one second stitching channel 7, the cover plate 2 is also provided with one second stitching channel 7, the panel 4 is also provided with one second stitching channel 7, and the three second stitching channels overlap when the base plate 1 and the panel 4 (the first cover plate 2 is located between the base plate 1 and the panel 4) are covered together.

The third stitching channel 8 extends through the base plate 1, the first cover plate 2, the second cover plate 3 and the panel 4, that is, the base plate 1 is provided with one third stitching channel 8, the cover plate 2 is also provided with one third stitching channel 8, the second cover plate 3 is also provide with one second stitching channel 8, and the panel 4 is also provided with one third stitching channel 8, and the four third stitching channels overlap when the base plate 1 and the panel 4 (the first cover plate 2 is located between the base plate 1 and the panel 4, and the second cover plate 3 is located between the first cover plate 2 and the panel 4) are covered together.

The present disclosure also uses edges of the first cover plate 2 to form a first edge 10 and a second edge 11, and edges of the second cover plate 3 to form a third edge 12.

A first garment back slit piece 21 is folded along the first edge 10 to cover the third stitching channel 8 on the first cover plate 2, and positions of corners of the garment back slit piece that needs to be sewn are located on the third stitching channel 8 of the first cover plate 2. Further, after the second cover plate 3 is covered on the first cover plate 2, the garment back slit piece continues to be folded along the third edge 12 to cover the third stitching channel 8 on the second cover plate 3, such that positions of corners of the garment back slit piece that needs to be sewn are located on the third stitching channel 8 of the second cover plate 3.

A second garment back slit piece 22 is folded along the first edge 11 to cover the third stitching channel 7 on the first cover plate 2, and positions of corners of the garment back slit piece that needs to be sewn are located on the second stitching channel 7 of the first cover plate 2.

In this way, after the first garment back slit piece 21 and the second garment back slit piece 22 are sewn together, the first garment back slit piece 21 and the second garment back slit piece 22 are folded by the first cover plate 2, and the folded first garment back slit piece 21 is folded again by the second cover plate 3, such that a preparation state of the corners of back slit is obtained, and stitching of the second stitching channel 7 and the third stitching channel 8 can be completed through a single stitching operation to obtain a back slit of the garment. Since the stitching and folding are guided by a template, edges and corners are symmetrical and neat, making the operation more convenient. An opening connected to the second stitching channel 7 is formed on the first cover plate 2, and an opening connected to the third stitching channel 8 is formed on the second cover plate 3, such that the sewn pieces can be removed more conveniently.

As a preferred embodiment, a limiting convex strip 13 is also provided on the base plate 1. Since a stitching position for joining the first garment back slit piece 21 and the second garment back slit piece 22 is near edges of the pieces, at least a portion of the limiting convex strip 13 should extend along a side edge of the first stitching channel 6. In this way, when placing the first garment back slit piece 21 and the second garment back slit piece 22, edges of the first garment back slit piece 21 and the second garment back slit piece 22 are positioned by the limiting convex strip 13, so as to ensure that the positions of the first garment back slit piece 21 and the second garment back slit piece 22 are accurate. When being actually placed, the first garment back slit piece 21 and the second garment back slit piece 22 are overlapped and aligned. Further, the limiting convex strip 13 is a sponge strip, where a height of the sponge strip cam be compressed when receiving external force, such that when the panel 4 is covered on the base plate 1, the limiting convex strip 13 is compressed to make the panel 4 fit the back slit pieces better, thus guaranteeing the stitching quality.

As a preferred embodiment, in order to prevent the slit pieces from offset during stitching, first grip strips 14 are arranged on mutually opposite surfaces of the base plate 1 and the panel 4, and are located on the first stitching channel 6 and the second stitching channel 7; second grip strips 15 are arranged on a surface of the first cover plate 2 facing the panel 4, and are located on side edges of the second stitching channel 7 and the third stitching channel 8; and a third grip strip 16 is arranged on a surface of the second cover plate 3 that faces the panel 4, and is located on a side edge of the third stitching channel 8. In this way, each of the garment back slit pieces between the two layers of plates has at least one side in contact with the grip strips along the edges of the stitching channels, that is, during the stitching process, the first grip strip 14 on the panel 4 is in contact with the first garment back slit piece 21, and the first grip strip 14 on the base plate 1 is in contact the second garment back slit piece 22. When the corners are sewn, the second grip strip 15 on the side of the third stitching channel 8 of the first cover plate 2 and the third grip strip 16 on the second cover plate 3 are in contact with the first garment back slit piece 21, and the second grip strip 15 on the side of the second stitching channel 7 of the first cover plate 2 is in contact the second garment back slit piece 22, ensuring that the slit pieces do not easily move during the stitching process, thereby improving the stitching quality.

Figure 5:
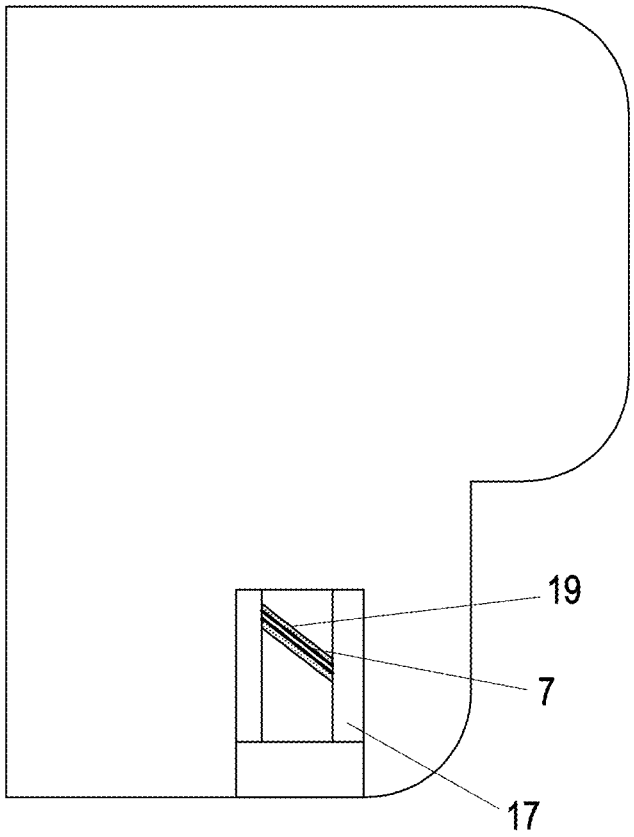
FIG. 5 is a schematic structural diagram of a third cover plate of a garment back slit stitching template according to an embodiment of the present disclosure.
Figure 6:
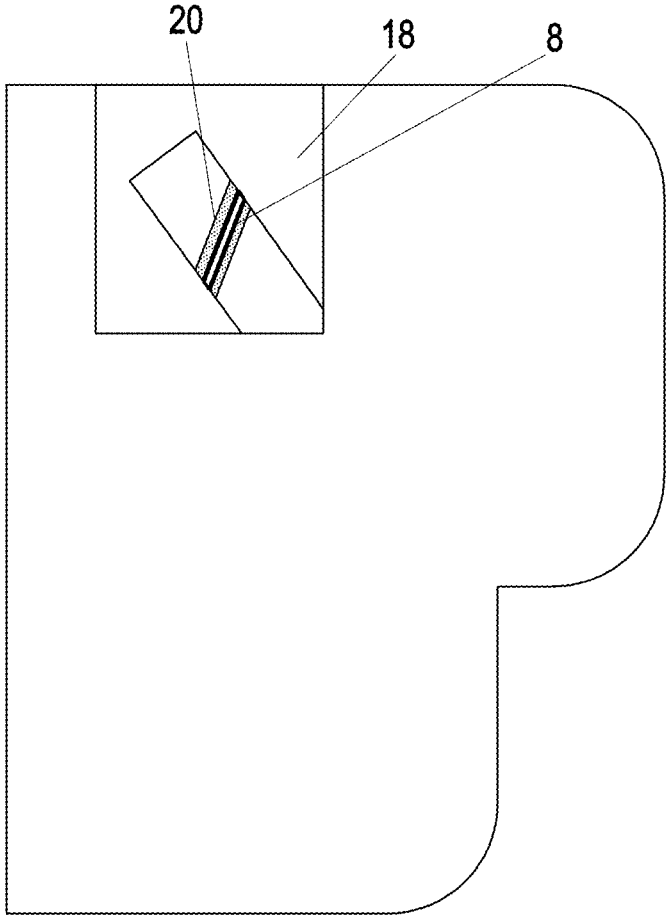
FIG. 6 is a schematic structural diagram of a fourth cover plate of a garment back slit stitching template according to an embodiment of the present disclosure.
Figure 7:
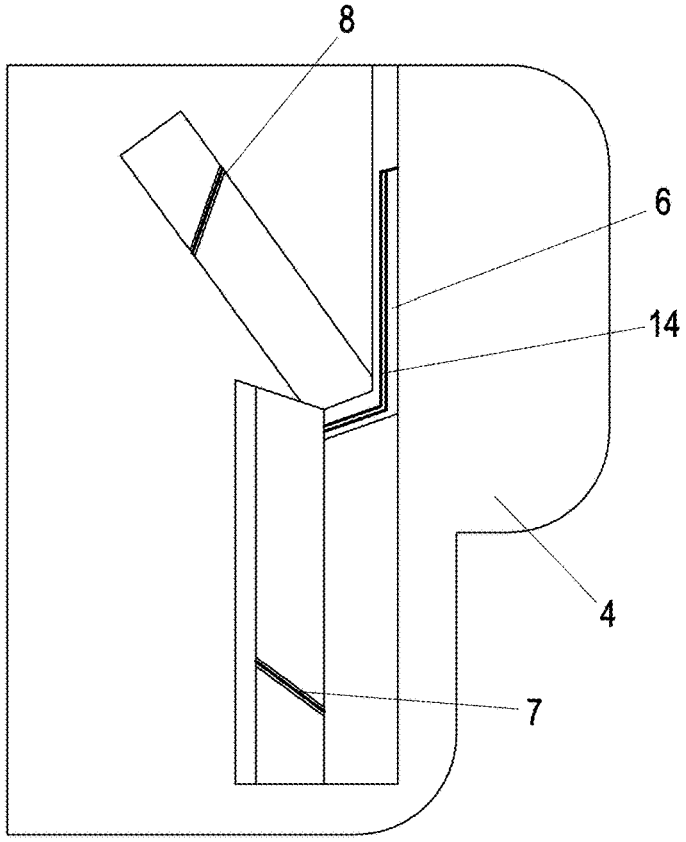
FIG. 7 is a schematic structural diagram of a panel of a garment back slit stitching template according to an embodiment of the present disclosure.
Figure 8:
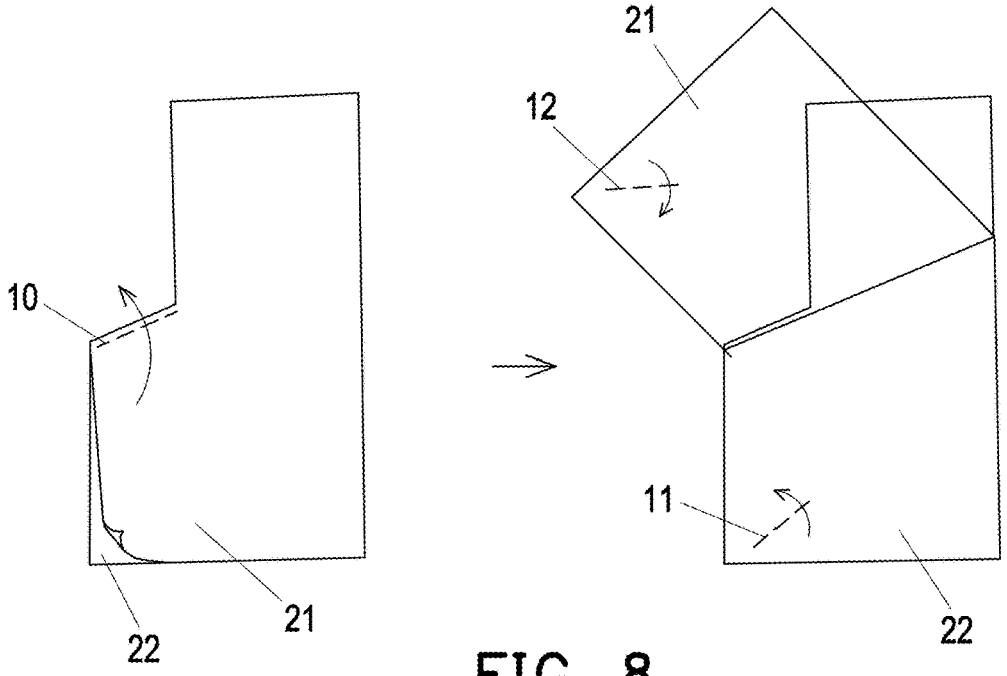
FIG. 8 is a schematic diagram of folding of a garment back slit piece according to an embodiment of the present disclosure.

Further referring to FIGS. 5 and 6, as a further preferred embodiment, the slit pieces need to be covered by the panel 4 at the end when the corners are sewn, but the panel 4 may be difficult to be covered after both the first garment back slit piece 21 and the second garment back slit piece 22 have completed the final folding. Therefore, the garment back slit stitching template is provided with a third cover plate 17, the third cover plate 17 is foldably covered on the first cover plate 2, and the third cover plate 17 can be flexibly connected to the base plate 1 via the flexible connecting strap 5. In addition, the second stitching channel 7 extends through the third cover plate 17, that is, the third cover plate 17 is also provided with the second stitching channel 7. In this way, after the second garment back slit piece 22 is folded along the second edge 11 of the first cover plate 2, the folded part of the second garment back slit piece 22 can be covered by the third cover plate 17, and a position is kept stable before the first garment back slit piece 21 is sewn, making the operation more conveniently. Of course, more further, a fourth grip strip 19 is arranged on a surface of the third cover plate 17 facing the first cover plate 2, and is located on a side edge of the second stitching channel 7, such that the second garment back slit piece 22 is more stable in the part between the first cover plate 2 and the third cover plate 17, thereby further improving the stitching quality.

It should be understood that the garment back slit stitching template can also be provided with a fourth cover plate 18, where the fourth cover plate 18 is foldably covered on the second cover plate 3, and the fourth cover plate 18 can be foldably connected to the base plate 1 via the flexible connecting strap 5. In addition, the third stitching channel 8 extends through the fourth cover plate 18, that is, the fourth cover plate 18 is also provided with the third stitching channel 8. In this way, after the first garment back slit piece 21 is folded along the first edge 10 of the first cover plate 2, and then folded again along the third edge 12 of the second cover plate 3, the second folded part of the first garment back slit piece 21 can be covered by the fourth cover plate 18, and a position is kept stable before the first garment back slit piece 21 is sewn (when the third cover plate 17 is not arranged, but only the fourth cover plate 18 is arranged), making the operation more conveniently. Of course, a fifth grip strip 20 is arranged on a side edge of the third stitching channel 8 on the side of the fourth cover plate 18 facing the second cover plate 3, such that the first garment back slit piece 21 is more stable in the part between the second cover plate 3 and the fourth cover plate 18, thereby further improving the stitching quality.

What is claimed is:

1. A garment back slit stitching template, comprising a base plate and a panel that are foldably connected to each other, wherein a foldable first cover plate and a foldable second cover plate are arranged between the base plate and the panel, and the second cover plate is foldably connected to the first cover plate; the garment back slit stitching template is further provided with a first stitching channel, a second stitching channel, and a third stitching channel, wherein the first stitching channel extends through both the base plate and the panel, and the first stitching channel is configured to stitch and join garment back slit pieces together; the second stitching channel extends through the base plate, the first cover plate, and the panel, the third stitching channel extends through the base plate, the first cover plate, the second cover plate, and the panel, and the second stitching channel and the third stitching channel are configured to stitch corners of the garment back slit pieces; the first cover plate is provided with a first edge and a second edge, the garment back slit pieces are folded along the first edge to cover the third stitching channel on the first cover plate, and the garment back slit pieces are folded along the second edge to cover the second stitching channel on the first cover plate; the second cover plate is provided with a third edge, the garment back slit pieces are folded along the third edge to cover the third stitching channel on the second cover plate; and the garment back slit stitching template further comprises a fourth cover plate, the fourth cover plate is foldably covered on the second cover plate, and the third stitching channel extends through the fourth cover plate.

2. The garment back slit stitching template according to claim 1, wherein a limiting convex strip is provided on the base plate, and at least a portion of the limiting convex strip extends along a side edge of the first stitching channel.

3. The garment back slit stitching template according to claim 2, wherein the limiting convex strip is a sponge strip.

4. The garment back slit stitching template according to claim 1, wherein first grip strips are arranged on opposite surfaces of the base plate and the panel, and are located on a side edge of the first stitching channel and a side edge of the second stitching channel; second grip strips are arranged on a surface of the first cover plate facing the panel, and are located on the side edge of the second stitching channel and a side edge of the third stitching channel; and a third grip strip is arranged on a surface of the second cover plate facing the panel, and is located on the side edge of the third stitching channel.

5. The garment back slit stitching template according to claim 1, further comprising a third cover plate, wherein the third cover plate is foldably covered on the first cover plate, and the second stitching channel extends through the third cover plate.

6. The garment back slit stitching template according to claim 5, wherein a fourth grip strip is arranged on a surface of the third cover plate facing the first cover plate, and is located on a side edge of the second stitching channel.

7. The garment back slit stitching template according to claim 1, wherein a fourth grip strip is arranged on a surface of the fourth cover plate facing the second cover plate, and is located on a side edge of the third stitching channel.

8. The garment back slit stitching template according to claim 1, wherein the first stitching channel on the base plate is covered with a horsehair lining.

* * * * *